US005681153A

United States Patent [19]

Weatherston

[11] Patent Number: 5,681,153

[45] Date of Patent: Oct. 28, 1997

[54] TWO ROTOR SLIDING VANE COMPRESSOR

[75] Inventor: Roger C. Weatherston, East Amherst, N.Y.

[73] Assignee: Carrier Corporation, Syracuse, N.Y.

[21] Appl. No.: 700,645

[22] Filed: Aug. 8, 1996

Related U.S. Application Data

[63] Continuation-in-part of Ser. No. 492,983, Jun. 21, 1995, Pat. No. 5,567,139.

[51] Int. Cl.[6] ..... F04B 19/02

[52] U.S. Cl. ..... 417/462; 417/410.3

[58] Field of Search ..... 417/462, 463, 417/410.3

[56] References Cited

U.S. PATENT DOCUMENTS

| | | | |
|---|---|---|---|
| 743,361 | 11/1903 | White | 417/462 |
| 1,867,198 | 7/1932 | Waite | 417/463 |
| 1,890,560 | 12/1932 | Burn | 417/463 |
| 2,574,921 | 11/1951 | Johnson | 417/463 |
| 2,684,038 | 7/1954 | Johnson | 91/493 |
| 4,936,111 | 6/1990 | Wilkinson et al. | 417/462 |

FOREIGN PATENT DOCUMENTS

| | | | |
|---|---|---|---|
| 517357 | 10/1919 | France . | |
| 727840 | 12/1931 | France | 417/462 |
| 482750 | 4/1938 | United Kingdom . | |

*Primary Examiner*—Timothy Thorpe
*Assistant Examiner*—Peter G. Korytnyk
*Attorney, Agent, or Firm*—Howard J. Greenwald

[57] ABSTRACT

A two-rotor, sliding member rotary compressor with an inner rotor, an outer rotor, and at least three sliding members between the inner rotor and the outer rotor. The inner rotor has an outer surface which contains at least one flat portion. The inner rotor is supported by support shafts on each of its ends. The compressor is comprised of a first end plate located on a first end of said inner rotor and a second end plate located on a second end of said inner rotor; each of the end plates supports the inner rotor through a set of bearings. The compressor also has a center housing with a circular interior having an inner surface that is eccentric to the inner rotor, an inlet port, and a discharge port. The outer rotor has a circular exterior that surrounds the inner rotor but is eccentric thereto.

1 Claim, 5 Drawing Sheets

TWO ROTOR SLIDING VANE COMPRESSOR

CROSS REFERENCE TO RELATED PATENT APPLICATIONS

This application is a continuation-in-part of applicant's patent application U.S. Ser. No. 08/482,983, filed on Jun. 21, 1995 now U.S. Pat. No. 5,567,139.

FIELD OF THE INVENTION

A two-rotor, sliding vane compressor in which both rotors rotate at the same angular velocity and in which the sliding vanes have flat heads.

BACKGROUND OF THE INVENTION

Sliding vane compressors are well known to those skilled in the art and are disclosed, e.g., in U.S. Pat. Nos. 5,310,326, 4,384,828, 4,242,065, 4,132,512, 3,877,853, and the like. The disclosure of each of these United States patents is hereby incorporated by reference into this specification.

The classical single rotor-sliding vane compressor is one of the oldest type of compressors on the market. The reason for its early arrival is found in its simplicity of construction and ease of machining. Its disadvantage is that it must operate at low speeds, except for very small machines, requiring large sized compressors, and its efficiency is not sufficiently high to compensate for its size. As a result, except for the very low capacities, the classical sliding vane compressor has fallen into disfavor with the arrival of improved machining techniques that has fostered other types of compression devices that were not possible to produce in the early days of the sliding vane compressor.

It is an object of this invention to provide a sliding vane compressor which can be operated at a substantially higher speed than prior art sliding vane compressors.

It is another object of this invention to provide a sliding vane compressor which, during its operation, will experience substantially reduced tip loading on the sliding vanes.

It is yet another object of this invention to provide a sliding vane compressor which is substantially more durable than prior art sliding vane compressors.

It is another object of this invention to provide a sliding element/sliding vane compressor working within a working chamber that will have a very small clearance volume at the end of the compression stroke.

SUMMARY OF THE INVENTION

In accordance with this invention, there is provided a two-rotor sliding member rotary compressor comprising an inner rotor with an outer surface with at least one flat portion, an outer rotor, means for rotating the inner and outer rotors at the same angular velocity, and at least three (and preferably four) sliding members disposed between the inner and outer rotors.

The inner rotor contains an outer surface comprising at least one flat portion. As the inner rotor rotates, the sliding member slides on the flat surface and coacts with the outer rotor.

The compressor contains a first end plate located on a first end of the inner rotor and a second end plate located on a second end of the inner rotor; each of these end plates supports the inner rotor through a set of bearings.

The compressor also contains a center housing with a circular interior that is eccentric to the inner rotor, the housing being disposed between the two end plates.

The outer rotor has a circular exterior comprised of at least three recesses that surrounds the inner rotor but is eccentric thereto. This outer rotor is mounted on a second set of bearings disposed in the first and second end plates.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 7:
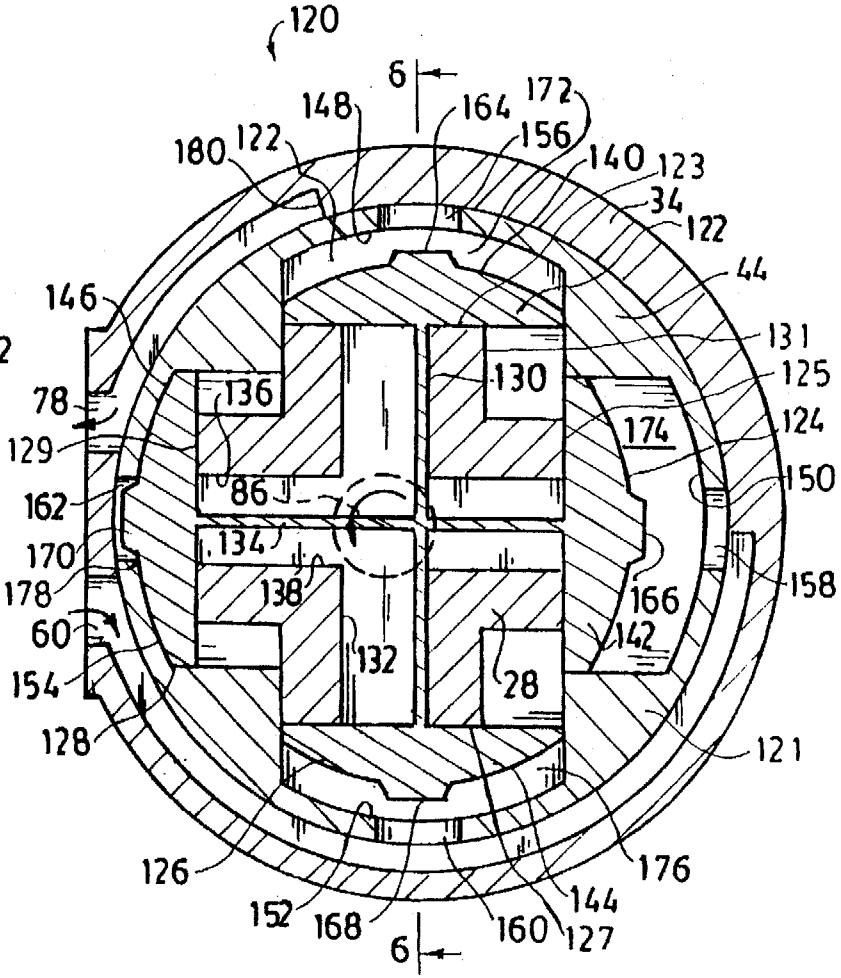
FIG. 7 is another sectional view of the preferred embodiment of FIG. 6.
Figure 8:
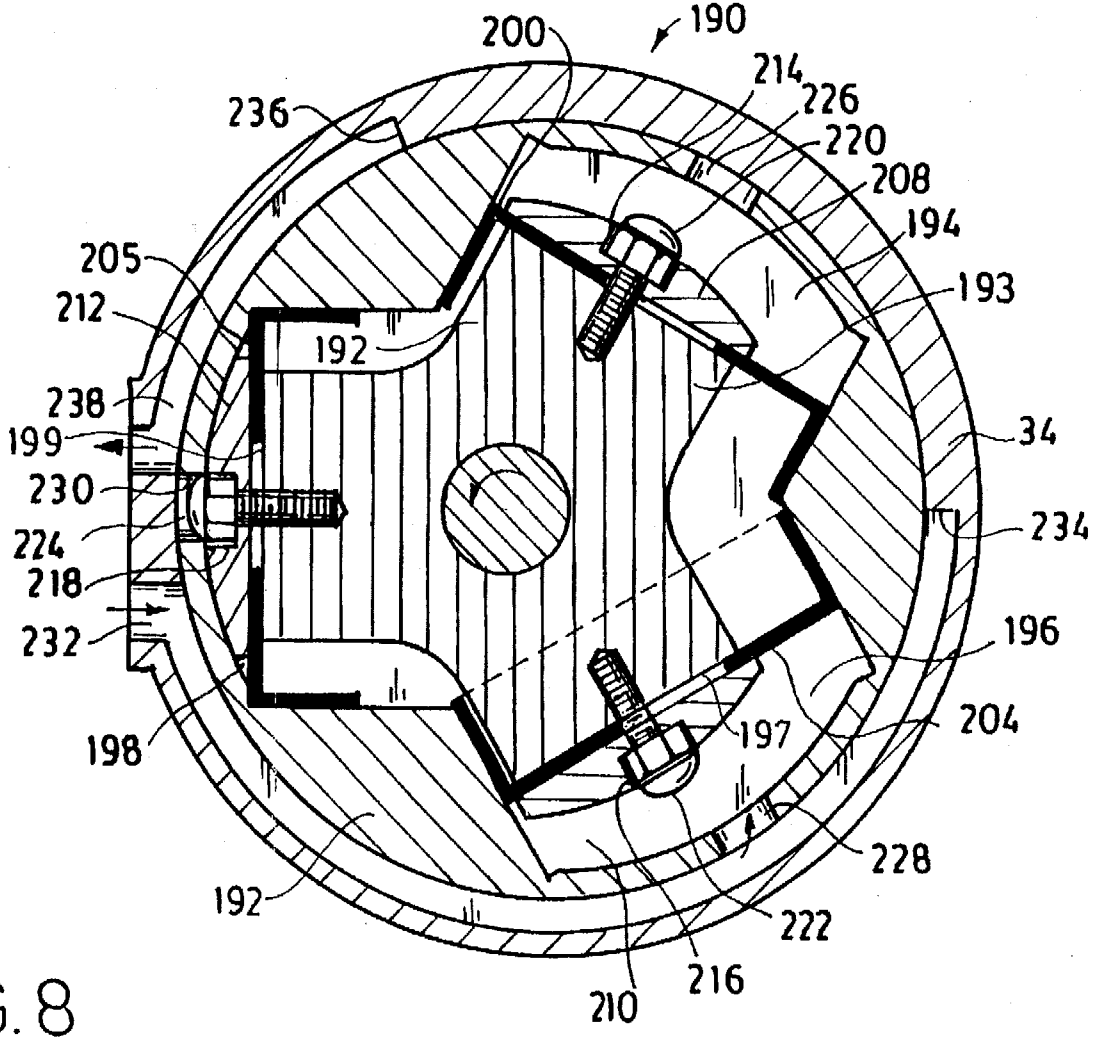
FIG. 8 is a sectional view of yet another preferred embodiment of the invention.

In the specification, applicants will describe several different embodiments of his invention. The embodiments depicted in FIGS. 1–5 are described in the first part of the specification; thereafter, the embodiments depicted in FIGS. 6, 7, and 8 are described.

The present invention relates, in part, to a two rotor compressor of the sliding vane type so arranged and constructed as to provide an efficient precompression of the fluid in a working chamber prior to its exposure to a high pressure discharge port. This sliding vane compressor is an improved version of the old line, single rotor-sliding vane compressor. It will be illustrated in this specification by reference to two different embodiments which utilize the same inventive concepts.

The present invention modifies the classical sliding vane compressor in such a way as to improve both its speed characteristics and its efficiency and, optionally, to provide a small clearance volume.

A prior art sliding vane compressor

Figure 1:
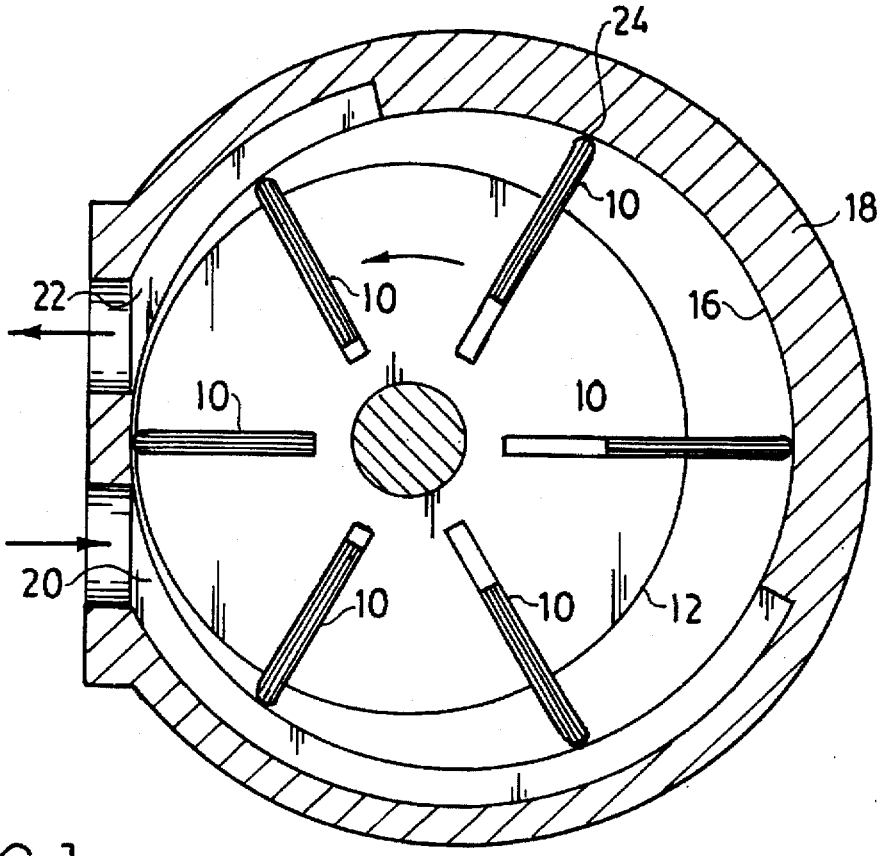
FIG. 1 PRIOR ART
FIG. 1 is a sectional view of the interior of a conventional sliding vane compressor.

For the purposes of illustration, it is beneficial to compare the present two rotor sliding vane design to the classical, single rotor design; the latter design is illustrated in FIG. 1. Such a a comparison will demonstrate the advantages of the two rotor design.

Figure 1A:
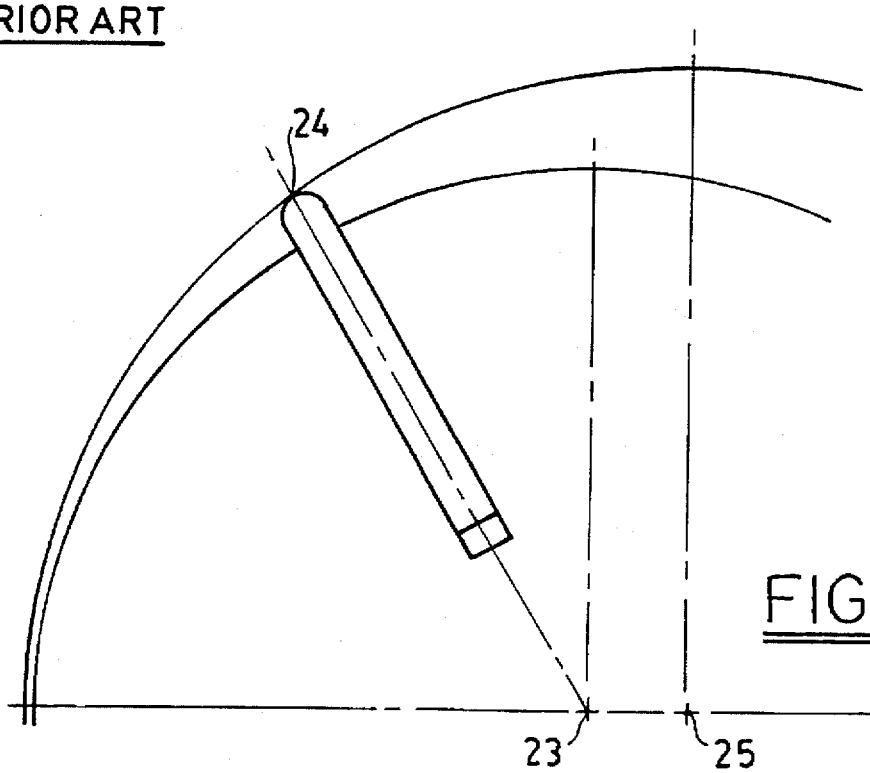
FIG. 1A is an expanded sectional view of the sliding vane compressor of FIG. 1, illustrating the contact between a vane tip and the housing of such compressor.

Referring to FIG. 1, and in the conventional design depicted therein, the sliding vanes 10 are thrown outwardly by centrifugal force as rotor 12 rotates about shaft 14, thereby causing vanes 10 to contact the inner surface 16 of fixed housing 18. Housing 18 is comprised of inlet passage 20 and outlet passage 22. Because the center 23 of rotor 12 and the center 25 of the fixed housing inner surface 16 are eccentric to each other (see FIG. 1A), the tip 24 of the sliding vane 10 does not contact the housing in a normal geometric or flush manner. Theoretically, there is only a line contact of the vanes 10 with the housing inner surface 16, and the contact pressure levels are high because of this non-normal relationship. Moreover, the vane tip 24 wiping velocity is also high, being equal to the tip velocity of the vanes 10 themselves. Because of the high contact pressure and wiping velocities, the classical single rotor compressor depicted in FIGS. 1 and 1A is limited to relatively low speeds except for very small devices, like air tools.

The present invention overcomes these unfavorable features by the incorporation of a second rotor. The construction and operation of the two rotor compressor to achieve these objectives may be understood by reference to FIGS. 2 and 3.

A preferred two rotor compressor of the invention

Figure 2:
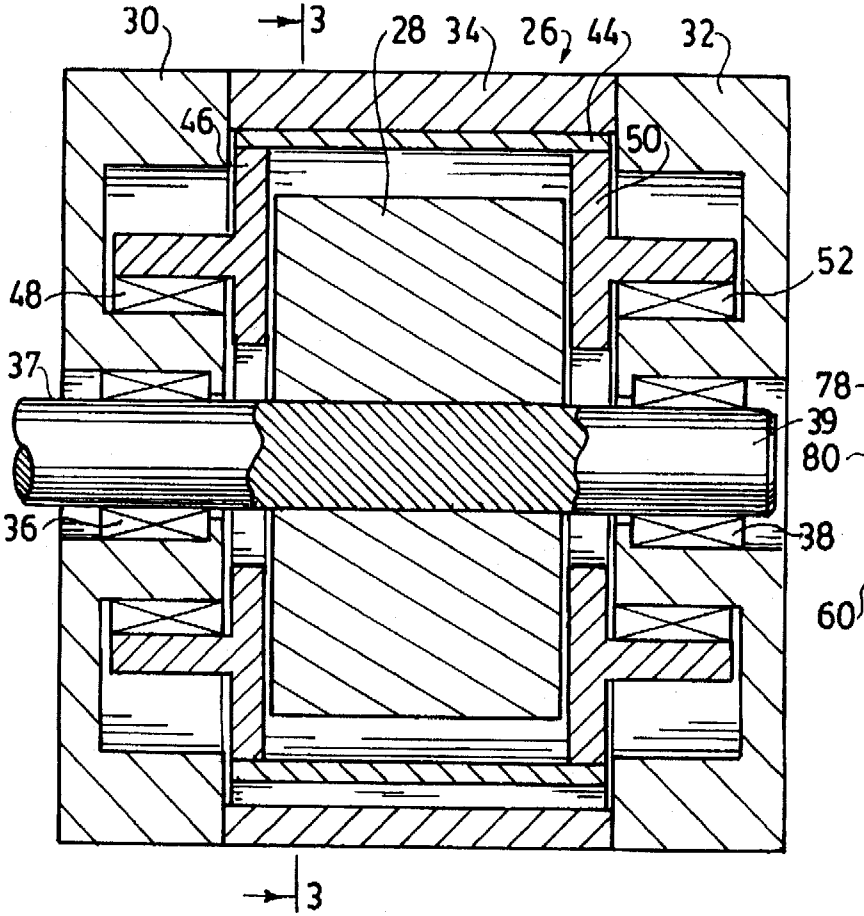
FIG. 2 is sectional view of one preferred embodiment of a two-rotor sliding vane compressor of the invention, illustrating the bearing suspension of the two rotors in the end plates.

FIG. 2 is a cross-sectional view of a compressor 26 taken through the axis of an inner, vane-carrying, rotor 28.

Referring to FIG. 2, it will be seen that the main support structures for the compressor 26 are end plates 30 and 32 and center housing 34. The inner rotor 28 is supported by bearing 36 into end plate 30 and bearing 38 to end plate 32; inner rotor 28 is preferably supported by support shafts 37 and 39 at each of its ends.

Figure 3:
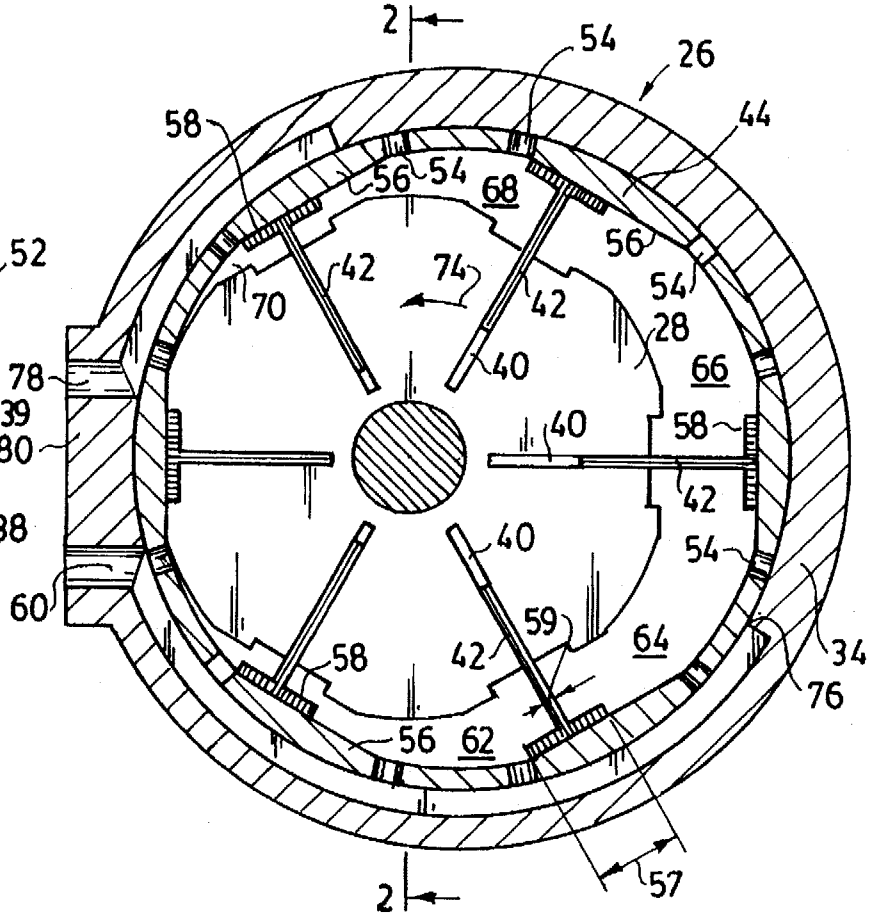
FIG. 3 is a sectional view, taken along lines 3—3 of FIG. 2, of the compressor of FIG. 2, illustrating the structure of the vanes and the inner and outer rotors.

In the embodiment depicted in FIGS. 2 and 3, the inner rotor 28 contains six vane slots, like vane slots 40, and guides six vanes, like vanes 42.

As will be apparent to those skilled in the art, the compressor 26 may contain fewer or more vane slots 40 and vanes 42. Thus, a few as two vane slots 40 and two vanes 42 may be used; and as many as about 16 such vane slots 40 and vanes 42 may be used. It is preferred, however, to use from about 4 to about 12 such vane slots 40 and vanes 42.

Referring again to FIGS. 2 and 3, the outer rotor 44 is supported by means of side plate member 46 through bearing 48 to end plate 30 and side plate member 50 through bearing 52 to end plate 32. It should be noted that side plate members 46 and 50 are the support members for the outer rotor 44, but they also act as side plates for inner rotor 28. Also, it is to be noted that side plates 46 and 50 and the inner rotor 28 have very limited velocity with respect to each other since the side plates and the rotor are both in motion.

Referring again to FIGS. 2 and 3, and in the preferred embodiment depicted, outer rotor 44 has twelve discharge ports 54. In the embodiment depicted, there are two discharge ports 54 for each vane 42. However, as will be apparent to those skilled in the art, more or fewer such discharge ports may be used. It is preferred, however, to use from about 1 to about 2 discharge ports 54 for each vane 42.

Referring again to FIGS. 2 and 3, and in the preferred embodiment depicted, outer rotor 44 has six flat surfaces 56. It may be observed that the heads 58 of the vanes 48 are preferably flat to match the six flat surfaces 56.

In general, there will be at least one flat surface 56 for each vane 42. It is preferred that there be one flat surface 56 for each vane 42.

Referring again to FIGS. 2 and 3, in operation gas (not shown) is drawn in through the housing entrance passage 60 and fills the working pocket volumes 62, 64, 66, 68, and 70 between the vanes 42, the inner rotor 28, and the outer rotor 44, through ports 54. Both rotors 28 and 44 rotate in the direction indicated by the arrow 74. At some point 76, the housing 34 comes in close contact to outer rotor 44 and the pocket volumes become trapped. As rotation continues, the volume of the pockets is reduced, and the gas becomes compressed. At some point, when the desired pressure level is reached, a port 54 becomes exposed to discharge port 78, and the gas flows out from the working pockets. A small piece 80 of the housing 34 separates the high pressure gas flowing out of port 78 and from inlet port 60.

Figure 5:
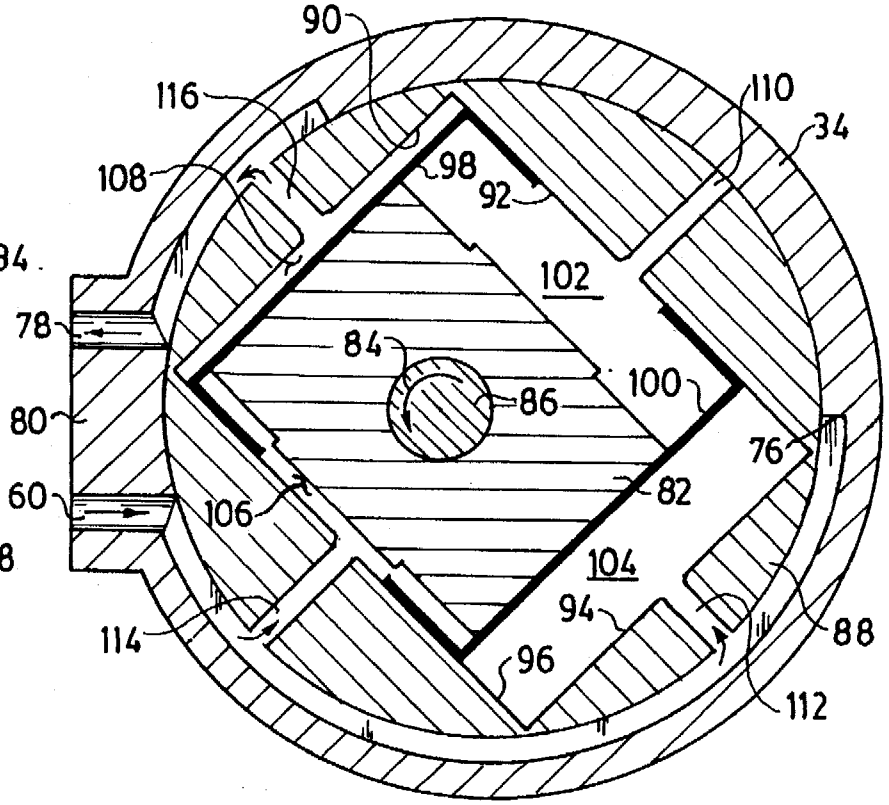
FIGS. 4 and 5 are sectional views of another preferred embodiment of the two-rotor sliding vane compressor of this invention, illustrating said embodiment in different angular positions, the rotor suspensions depicted in FIGS. 4 and 5 being identical to that depicted in FIG. 2.
Figure 4:
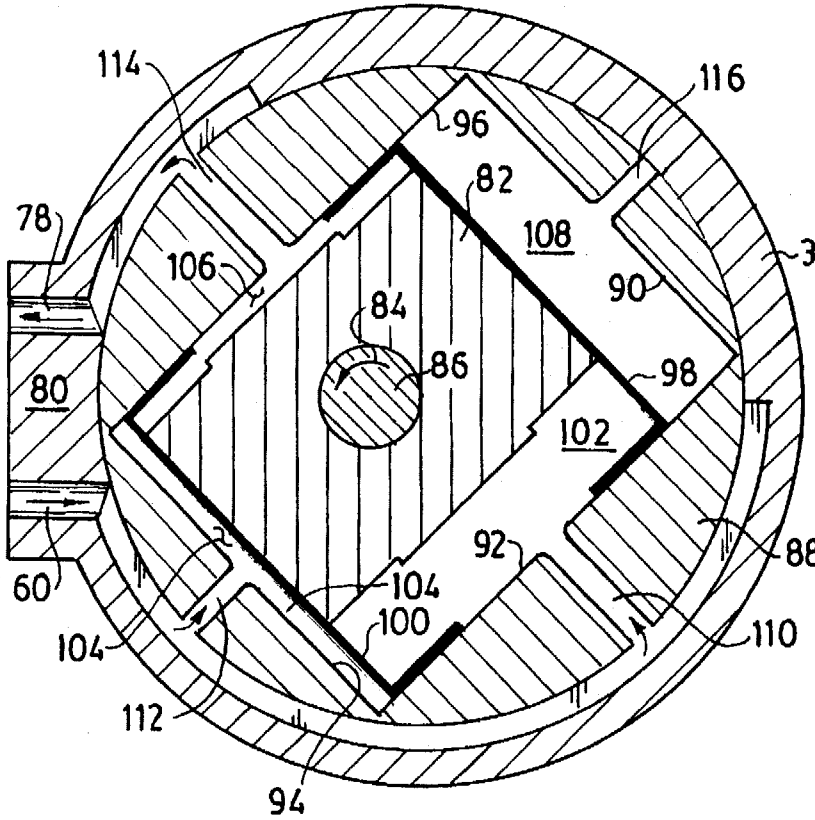
Figure 6:
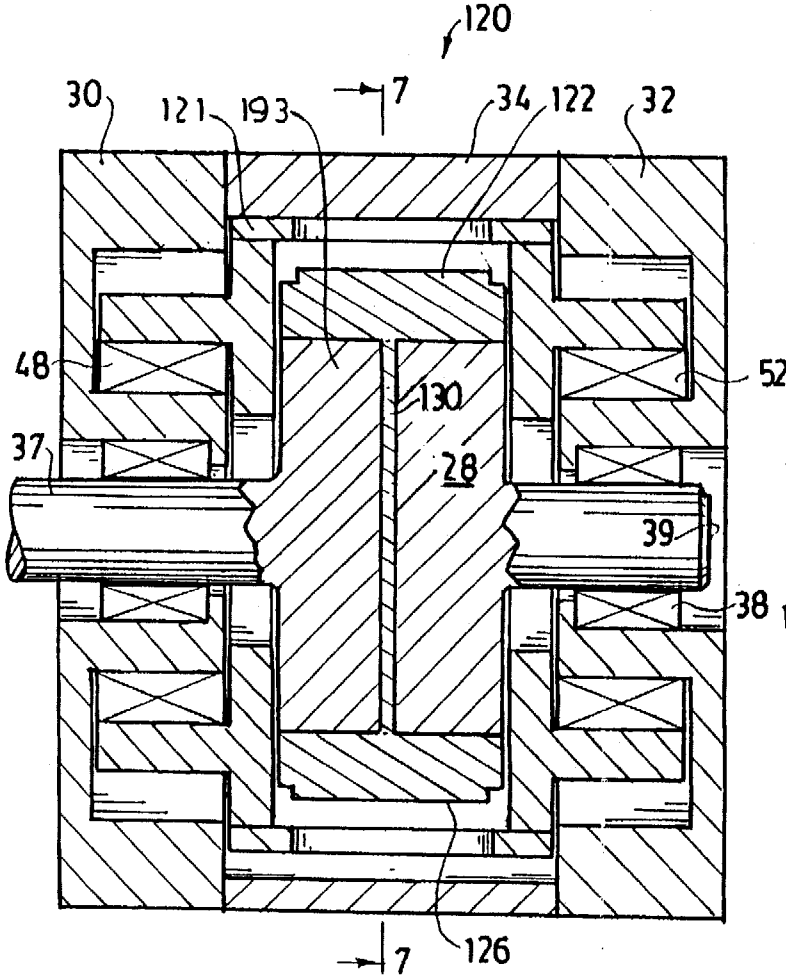
FIG. 6 is a sectional view of another preferred compressor of the invention.

FIGS. 4 and 5 illustrate another embodiment of the invention; in FIG. 5, the inner rotor 82 has rotated 90 degrees in the direction of arrow 84 about shaft 86. As will be apparent to those skilled in the art, the side view of the design of these FIGS. 4 and 5, which illustrates the support means for the inner and outer rotors, and bearing layouts, is exactly the same as FIG. 2 of the first design Although an off-hand observation of the compressor center section of FIGS. 4 and 5 might lead one to conclude that a different compressor is being depicted, it should be apparent that the compressor of FIGS. 4 and 5 utilizes the same inventive concepts as employed in the compressor of FIG. 3. Thus, both compressors utilize a second outer rotor with internal flats that coact flushly with flat vane heads emanating from a first inner rotor, such coaction being made possible by the rotational synchronization of the inner and outer rotors. In reality, the alternative design of FIGS. 4 and 5 is but a limiting case of the general configuration in which the entire inner surface of the outer rotor consists of rectangularly arranged flats, and wherein the center inner rotor also becomes rectangular, supporting one vane on each of its opposing ends.

Referring to FIGS. 4 and 5, it will be seen that outer rotor 88 surrounds the inner rotor 82 and is eccentric to it, in a manner similar to that of the design of FIG. 3. Inner rotor 82 rotates around shaft 86. The outer rotor 88 is supported by side plates (not shown in FIGS. 4 and 5) like those side plates 46 and 50 of FIG. 2. The outer rotor 88 is comprised of internal flats 90, 92, 94, and 96. Flats 92 and 96 coact with the flat heads of sliding vanes 98 and 100, forcing the two rotors to rotate in synchronization. The four working chambers 102, 104, 106, and 108 coact cyclically with the inlet passage 60 and outlet passage 78, in center housing 34 through ports 110, 112, 114, and 116 in the same manner as depicted in the design of FIG. 3. Block 80 of center body 34 separates the high pressure gas in high pressure outlet 78 form lower pressure gas in inlet passage 60.

Referring again to FIG. 4, working chambers 104 and 102 are ingesting fresh gas from inlet passage 60, chamber 108 is sealed off while the gas is being compressed, and working chamber 106 is delivering gas to discharge port 78. In FIG. 5, by comparison, both rotors are advanced 90 degrees counterclockwise and working chambers 106 and 104 are ingesting gas from inlet passage 60, chamber 102 is undergoing compression, and working chamber 108 is delivering gas to discharge passage 78.

In the construction of the embodiment of FIGS. 4 and 5, there preferably is a structural tie between the ends of sliding vanes 98 and 100 to the ends of slide to hold them snug against the ends of the inner rotor block 82. However, for the sake of simplicity of representation, the depiction of this structural tie has been omitted from FIGS. 4 and 5.

In one embodiment, the device of FIGS. 4 and 5 is utilized as an internal combustion engine.

Features of the claimed compressors

Referring to FIG. 3, the centrifugal outward force of vanes 40 reacts with the outer rotor 34 through flat vane heads 58 acting on the outer rotor flat surfaces 56. This flush contact relationship forces both the inner and outer rotors to rotate at the same angular velocity at all times. The distance vane head 58 oscillates back and forth on rotor flat surface 56 is equal to four times the distance between the centers of rotation of the inner rotor and the outer rotors, for each revolution of the rotors. This distance is equal to about one tenth of the distance that each vane head travels. Hence, comparing the present design to the classical single rotor design, the wiping velocity of the vane tip, for the same size machine, is reduced by about ninety percent. This is a huge advantage. Additionally, the head of the vane 42 can be made to have at least ten times the tip contact area on the flats 56 of the outer rotor 34 as could be attained in a single rotor compressor of the same size. The vanes become "T" or "L" shaped, being much wider at the tip than at the slot position. Hence, the operational advantages of employing the present two rotor design over the classical design are obvious and overwhelming.

It will be apparent to those skilled in the art that the advantages discussed for the embodiment of FIG. 3 are equally present for the embodiment of FIGS. 4 and 5.

There are several other two rotor vane compressors found in the patent literature, but none of these designs feature a synchronization of the angular velocity of the two rotors. This feature makes it possible to employ a flat head on the inside of the outer rotor that will be in constant normal relationship with the head of a vane from the inner rotor. This also allows for a flat vane head which can be extended to reduce the contact pressure. Moreover, since the position of the outer rotor is tied to the position of the vanes, it is possible and practical to add ports to the outer rotor that act as a valving mechanism with respect to the inlet and outlet passage means in the housing that surrounds the rotor. If, as in other designs, the outer rotor is allowed to seek its own speed, depending upon vane tip drag, there is no synchronization between the vanes and the other rotor, and therefore, it cannot act as a timed valving device.

To these skilled in the art obvious changes could be made for particular applications. Crank arms could be employed between the side plate member 46 and inner rotor 28 (see FIG. 2) to force synchronization of the two rotors if the inertial force of the vanes on the outer rotor flats proved to be insufficient to do the job. The number of vanes could be increased or decreased. Skirts could be added to each end of the vanes to reduce the leakage between them and the side plates with which they coact, or through vanes could be employed. It is also possible to relocate the inlet our outlet passage means into the end plates.

A rotary piston type of compressor

FIGS. 6 and 7 illustrate another embodiment of the invention which is somewhat similar from the embodiment depicted in FIGS. 4 and 5 in that it contains a multiplicity of working chambers within the outer rotor adapted to receive and coact with multiplicity of sliding pistons.

FIG. 6 is a sectional view of this embodiment. Referring to FIGS. 5 and 6, it will be seen that compressor 120 is comprised of many of the same elements of the compressors depicted in FIG. 4 and 5, but wherein the sliding elements 98 and 100 of FIGS. 4 and 5 are replaced by piston-like sliding elements 122, 124, 126, and 128 that coact with flat portions 123, 125, 127, and 129 of the outer surface 131 of inner rotor 28.

Referring again to FIGS. 6 and 7, it will be seen that connecting rod 130 connects sliding elements 126 and 122. Connecting rod 130 is not entirely coplanar with connecting rod 134, being axially displaced from each other by a distance which generally does not exceed the thickness of the connecting rod. Thus, the axial distance between connecting rods 130 and 134 is generally 0.1 inches.

As will be apparent to those skilled in the art, and referring to FIG. 7, connecting rod 130 is disposed within a slot (not shown) within inner rotor 28. In the position depicted in FIG. 7, connecting rod 130 is at one position of its travel. However, as will be apparent, as inner rotor rotates 180 degrees, rod 130 will be back in the same position as shown but surface 132 will have rotated to the position indicated for 130.

Referring again to FIGS. 6 and 7, it will be seen that connecting rod 134 connects sliding elements 128 and 124. Connecting rod 134 is not entirely coplanar with connecting rod 130, being axially displaced from each other by a distance which generally does not exceed the thickness of the connecting. Thus, the axial distance between connecting rods 130 and 134 is generally 0.1 inches.

As will be apparent to those skilled in the art, and referring to FIG. 7, connecting rod 134 is disposed within a slot (not shown) within inner rotor 28. In the position depicted in FIG. 7, connecting rod 134 is at the center of its travel. However, as will be apparent, as inner rotor rotates 90 degrees, rod 134 will be at the position depicted for rod 130.

Referring again to FIGS. 6 and 7, it will be seen that each of connecting rods 130 and 134 is connected to dome-shaped sliding elements 122, 124, 126, and 128. As will be seen by reference to FIGS. 6 and 7, each of these sliding elements has an arcuate top surface 140, 142, 144, and 146 adapted to be received within and coact flushly with inner arcuate surfaces 148, 150, 152, and 154 of outer rotor 121 so that the clearance volume at the end of the stroke is essentially zero.

In the embodiment depicted in FIGS. 6 and 7, arcuate top surfaces 140, 142, 144, and 146, and inner arcuate surfaces 148, 150, 152, and 154 are all circular. In other embodiments, not shown, these arcuate surfaces may be non-circular surfaces which are generally curvilinear and, thus, may be shaped like an ellipse, an ovoid, etc.

Referring again to FIGS. 6 and 7, it will be seen that outer rotor 121 is comprised of ports 156, 158, 160, and 162. In the preferred embodiment depicted in FIGS. 6 and 7, in order to minimize the amount of the clearance volume, each of arcuate surfaces 140, 142, 144, and 146 contains a plug-like protrusion, such as protrusions 164, 166, 168, and 170, adapted to fit within and mate with ports 156, 158, 160, and 162.

Referring again to FIGS. 6 and 7, and in the preferred embodiment depicted therein, it will be seen that each of four moving elements 122, 124, 126, and 128 is disposed within one of four working chamber recesses 172, 174, 176, and 178 in outer rotor 121, within which they are adapted to reciprocate in a linear fashion.

It is preferred that inner rotor 28 be comprised of at least three such working chambers 172, 174, and 176.

In one embodiment, not shown, the sliding elements 122, 124, 126, and 128 have a circular shape. In another embodiment, depicted in FIGS. 6 and 7, the sliding elements 122, 124, 126, and 128 have a substantially rectangular shape.

Referring to FIG. 7, and in the operation of the device depicted therein, fluid will enter passageway 60 and be inducted into the volume between the dome 144 and the inner surface 152 of sliding member 126 through port 160, and will continue to be induced until the rotor 28 rotates to the position depicted for sliding element 124, at which point the suction process will stop. At that point, port 158 becomes sealed off by center body 34, and compression of volume 174 begins. When each port 156, 158, 160, and 162 arrives at position 180 of center housing 34, compression will be complete and the discharge process will start; and the compressed gas will leave through internal passageway 78.

FIG. 8 is a sectional view of a compressor 190 whose outer rotor 192 is comprised of working chambers 194, 196, and 198 within which are disposed sliding members, such as sliding vanes 200, 204, and 206 which coact with flat surfaces 195, 197, and 199 on inner rotor 193. Each of said vanes are retained by caps 208, 210, and 212, each of which are bolted to inner motor 193 via hold down bolts 214, 216, and 218. The heads 220, 222, and 224 of bolts 214, 216, and 218 are adapted to be received within ports 226, 228, and 230 so as to minimize the clearance volume. In another embodiment, not shown, no such heads or plugs are used to be received within such ports.

As will be apparent to those skilled in the art, the end view of the compressor 190 will be similar to the end view depicted in FIG. 6.

In the operation of compressor 190, fluid flows into inlet 232 and enters working chamber 196 through port 228, and the inlet suction process will terminate when suction port 228 arrives at position 234 in housing 34. When each discharge port 226, 228, and 230 arrive at position 236, the discharge process will begin through discharge passage 238.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A two-rotor, sliding member rotary compressor for compressing gas comprising an inner rotor, an outer rotor, means for rotating said inner rotor and said outer rotor at the same angular velocity, and at least a first sliding member, a second sliding member, and a third sliding member disposed between said inner rotor and said outer rotor, wherein:

(a) said inner rotor is comprised of an outer surface, and said outer surface is comprised of one flat portion for each of said sliding members, whereby, as said inner rotor rotates, each of said sliding members slides on said flat surface on said inner rotor and coacts with said outer rotor;

(b) said inner rotor is supported by support shafts on each of its ends;

(c) said compressor is comprised of a first end plate located on a first end of said inner rotor and a second end plate located on a second end of said inner rotor, wherein each of said first end plate and said second end plate supports said inner rotor through a first set of bearings;

(d) said compressor is comprised of a center housing with a circular interior comprising an inner surface that is eccentric to said inner rotor, an inlet port, and a discharge port, said housing being disposed between said first end plate and said second end plate;

(e) said outer rotor has a circular exterior that surrounds said inner rotor but is eccentric thereto;

(f) said outer rotor is mounted on a second set of bearings disposed in said first end plate and said second end plate; and (g) said outer rotor is comprised of a first working chamber, a second working chamber, and a third working chamber, wherein:

1. said first sliding member is disposed within said first working chamber, said second sliding member is disposed within said second working chamber, and said third sliding member is disposed within said third working chamber,
2. each of said first working chamber, said second working chamber, and said third working chamber is comprised of a working chamber port,
3. said working chamber port coacts closely with said inner surface of said circular interior of said center housing to thereby seal off said working chamber for at least about 90 degrees of rotation of said outer rotor, whereby there is a substantial decrease in volume between the inside of the outer rotor and the outside of the inner rotor resulting in an increase of gas pressure in said working chamber prior to the time said working chamber port is exposed to said discharge port.

* * * * *